US005398470A

United States Patent [19]

Ritter et al.

[11] Patent Number: 5,398,470

[45] Date of Patent: Mar. 21, 1995

[54] REINFORCEMENT BODY FOR A FLOOR SLAB

[75] Inventors: Klaus Ritter; Gerhard Ritter, both of Graz; Klaus Matz, Graz-Weinitzen, all of Austria

[73] Assignee: AVI Alpenländische Veredelungs-Industrie Gesellschaft m.b.H., Raaba, Austria

[21] Appl. No.: 263,950

[22] Filed: Jun. 22, 1994

Related U.S. Application Data

[60] Division of Ser. No. 164,686, Dec. 8, 1993, abandoned, which is a continuation of Ser. No. 867,157, Apr. 10, 1992, abandoned.

[30] Foreign Application Priority Data

Apr. 23, 1991 [AT] Austria ..... 837/91

[51] Int. Cl.[6] ..... E04C 2/26

[52] U.S. Cl. ..... 52/309.11; 52/309.12; 52/309.7; 52/649.1

[58] Field of Search ..... 52/309.4, 309.7, 309.11, 52/309.12, 405, 412, 694, 650

[56] References Cited

U.S. PATENT DOCUMENTS

| | | | |
|---|---|---|---|
| 2,592,634 | 4/1952 | Wilson | 52/694 |
| 3,288,428 | 11/1966 | Terry | 52/694 |
| 3,309,828 | 3/1967 | Tribble | 52/694 |
| 3,555,131 | 1/1971 | Weismann | 52/309.7 |
| 3,750,355 | 8/1973 | Blum | 52/309.12 |
| 3,879,908 | 4/1975 | Weismann | 52/309.12 |
| 3,943,676 | 3/1976 | Ickes | 52/309.11 |
| 4,104,842 | 8/1978 | Rockstead et al. | 52/650 |
| 4,128,975 | 12/1978 | Abate | 52/309.4 |
| 4,157,640 | 6/1979 | Jeannes | 52/309.7 |
| 4,236,364 | 12/1980 | Larsson et al. | 52/650 |
| 4,336,676 | 6/1982 | Artzer | 52/309.11 |
| 4,454,702 | 6/1984 | Bonilla-Lugo et al. | 52/309.12 |
| 4,486,996 | 12/1984 | Alejos | 52/309.11 |
| 4,530,191 | 7/1985 | Boisbluehe | 52/309.11 |
| 4,611,450 | 9/1986 | Chen | 52/309.12 |
| 4,614,013 | 9/1986 | Stevenson | 52/309.7 |
| 4,702,053 | 10/1987 | Hibbard | 52/309.12 |
| 4,785,602 | 11/1988 | Giurlani | 52/309.12 |
| 5,058,345 | 10/1991 | Martinez | 52/309.12 |

FOREIGN PATENT DOCUMENTS

| | | |
|---|---|---|
| 246962 | 5/1966 | Austria . |
| 0066647 | 12/1982 | European Pat. Off. . |
| 0069108 | 1/1983 | European Pat. Off. . |

*Primary Examiner*—Carl D. Friedman
*Assistant Examiner*—Winnie S. Yip
*Attorney, Agent, or Firm*—Frishauf, Holtz, Goodman & Woodward

[57] ABSTRACT

Reinforcement body for a cast concrete floor slab provided with stiffening ribs, having a foundation reinforcement (1), a distribution reinforcement (2) and at least one displacement body (8) e.g. of polystyrene foam, arranged between these reinforcements which delimits cavities to accept the stiffening ribs. The displacement body is rigidly fixed between the reinforcements by means of spacer wires (7) connecting the foundation reinforcement to the distribution reinforcement (2) at a selectable distance, e.g. by passing through the displacement body, so that the foundation reinforcement, the distribution reinforcement and the displacement body form a dimensionally stable unit. Additional reinforcement elements (10, 11, 15), can be placed in the rib cavities (9). The cavities are either formed in a one-part displacement body or formed between several displacement bodies and having predetermined directional course in the reinforcement body and predetermined width, in accordance with the static requirements of the floor slab including the stiffening ribs.

14 Claims, 4 Drawing Sheets

9
7
6
8
2
5
4
1
3

2
5
6
7
8
4
1
3

9
10
8
7
6
2
5
4
1
3

9
7
8
2
5
6
11
12
14
16
4
1
13
15
3

9
7
8
2
5
6
11
12
14
16
4
1
3
15
13

9
7
8
2
5
6
17
11
12
14
16
4
1
3
13

REINFORCEMENT BODY FOR A FLOOR SLAB

This application is a division of application Ser. No. 08/164,686, filed Dec. 8, 1993, now abandoned, which, in turn, is a continuation of Ser. No. 07/867,157, filed Apr. 10, 1992, now abandoned.

FIELD OF THE INVENTION

The invention relates to a reinforcement body for a cast concrete floor slab provided with stiffening ribs, having a foundation reinforcement, a distribution reinforcement and at least one displacement body arrangement arranged between these reinforcements and consisting in particular of foam, the displacement body delimiting cavities to form the stiffening ribs.

BACKGROUND

A prefabricated concrete slab is known from Austrian patent 246 962, Hasslinger, the reinforcement body of which comprises an upper and a lower reinforcement mat as well as several displacement bodies keeping these reinforcement mats at a distance. The displacement bodies are at a distance from one another such that the formation of concrete stiffening ribs of predetermined width and height is made possible in the prefabricated slab. The two reinforcement mats are bound together with the aid of connecting stirrups, which are arranged in the spaces provided for the stiffening ribs, and thus the displacement bodies are clamped between the two reinforcement mats.

The disadvantage in the construction of this reinforcement body is firstly the inadequate fixing of the position of the displacement bodies, which is carried out only by the stirrups mentioned above. The reinforcement body also does not have sufficient rigidity to prevent displacement of the reinforcement mats relative to one another, for example when transported. In addition, the connecting stirrups can absorb shear forces only to an inadequate extent, as a result of which there is no statically effective shear reinforcement of the stiffening ribs. Since also the displacement bodies rest on the lower reinforcement mat, the concrete covering is not adequate for the lower prefabricated slab.

A reinforced concrete building slab provided with at least one displacement body and with reinforced stiffening ribs is known from European specification 0 066 647, Heinz in which shear reinforcement of the stiffening ribs is formed by projections moulded from the lower reinforcement mat, it being possible to connect the tips of the projections with the upper reinforcement mat. This reinforcement has the disadvantage that the displacement body is inadequately fixed by the projections, and in addition the concrete covering is inadequate both for the lower reinforcement mat as well as the upper reinforcement mat. In addition, the reinforcement of the stiffening ribs cannot be selected independently of the shaping of the foundation reinforcement mat.

THE INVENTION

It is the object of the invention to provide a reinforcement body of the type mentioned in the introduction containing a displacement body as an integrated component which is fixed in the reinforcement body to prevent floating of the same during the concreting process. The reinforcement body should be capable of being adapted, using simple means, to different static requirements of a floor slab. The reinforcement body should also be simple to manufacture and dimensionally stable, so that it can be transported and processed without undesirable changing of shape. In addition, the reinforcement body should make it possible to manufacture floor slabs to have a variable degree of prefabrication even in the manufacturer's factory.

Briefly, the reinforcement body of the invention is characterised in that the displacement body is rigidly fixed between the reinforcements in a known manner, by means of spacer wires connecting the foundation reinforcement to the distribution reinforcement at a selectable distance, so that the foundation reinforcement, the distribution reinforcement and the displacement body form a dimensionally stable unit. Additional reinforcement elements are placed in the rib cavities made either from a one-part displacement body or formed between several displacement bodies and having predetermined directional course in the reinforcement body and predetermined width, in accordance with the static requirements of the floor slab.

It should be mentioned that it is known from U.S. Pat. No. 4,500,763, Schmidt et al, to which European granted specification 0 069 108 corresponds to connect reinforcement mats extending parallel to one another by means of spacer wires, which at the same time penetrate and fix a foam insulating body arranged between the reinforcement mats.

However, no ribs are formed in these reinforcement bodies.

According to a preferred embodiment of the invention, the displacement body is retained by the spacer wires in a manner known per se at a predetermined distance from the foundation reinforcement and from the distribution reinforcement.

According to a further feature of the invention, the spacer wires, which penetrate the displacement body in a manner known per se, are designed as shear reinforcement elements.

In accordance with a feature of the invention, additional shear reinforcement elements, or lattice girders comprising upper rib, lower rib and infill wires, may be arranged in the rib cavities to increase the strength of the stiffening ribs. Furthermore, additional reinforcement elements designed as individual rods may be placed in the rib cavities.

A further feature of the invention envisages that the foundation reinforcement projects laterally of the distribution reinforcement on one side of the reinforcement body and/or the distribution reinforcement projects laterally of the foundation reinforcement on the opposite side.

DRAWINGS

Exemplary embodiments of reinforcement bodies of the invention are illustrated in more detail below with reference to the drawings.

Figure 5:
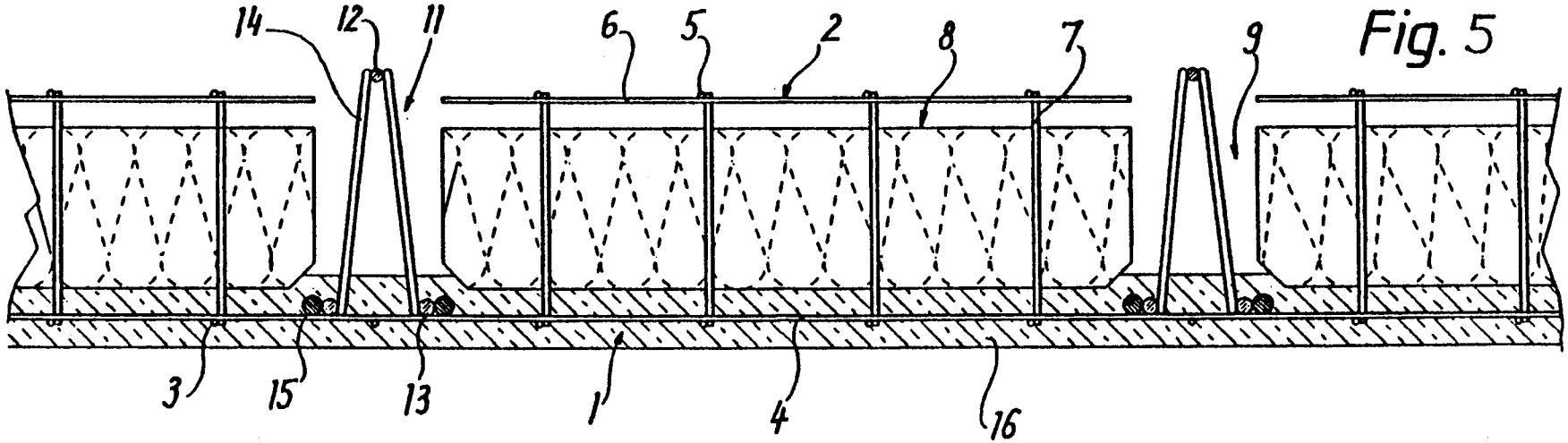
Figure 4A:
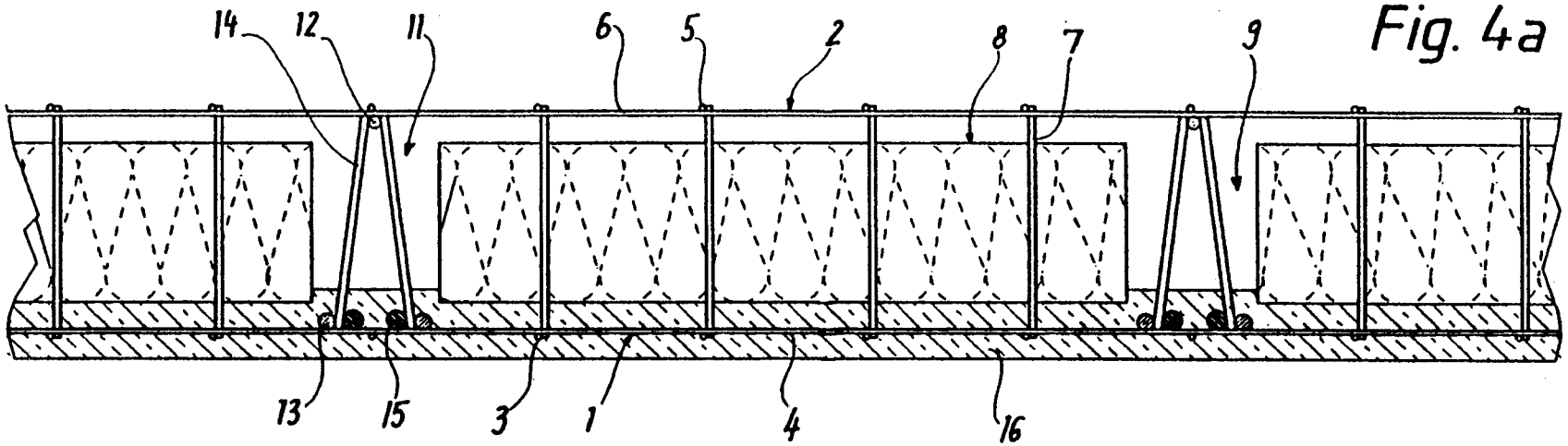
Figure 4B:
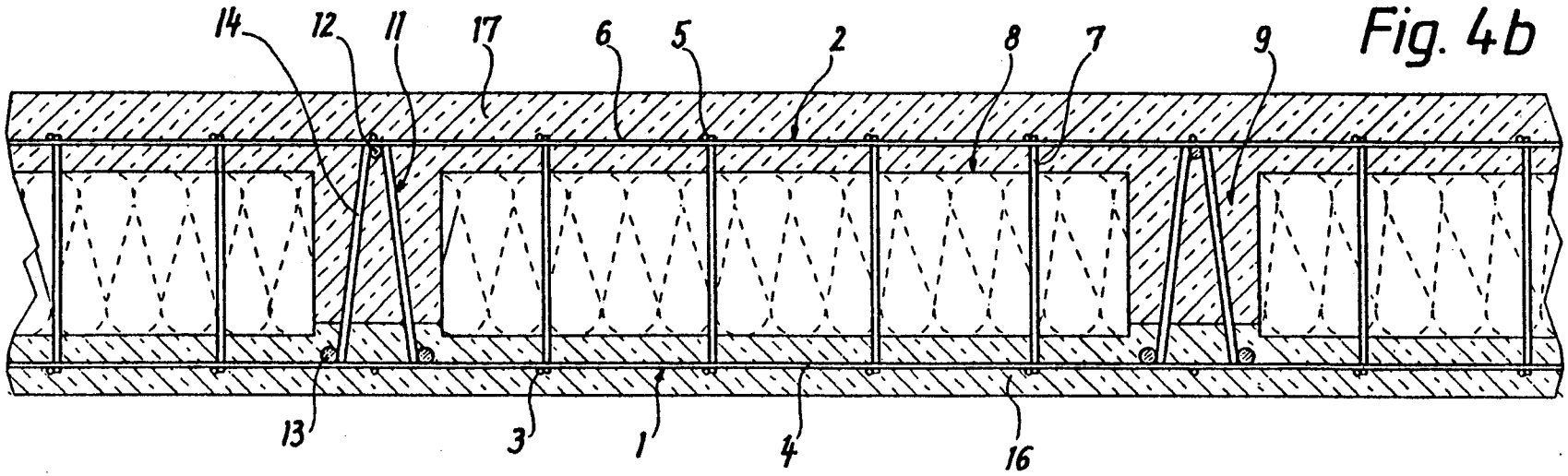

FIG. 4*a* shows a further embodiment with lattice girders as shear reinforcement elements and further additional reinforcement elements for reinforcing the stiffening ribs and using the reinforcement body of the invention in the form of a prefabricated element floor;

FIG. 4*b* shows the reinforcement body of FIG. 4*a*, but without the additional reinforcement elements, and its use in a completely prefabricated, singly reinforced cavity floor;

FIG. 5 shows a further embodiment of a reinforcement body of the invention; and

Figure 6:
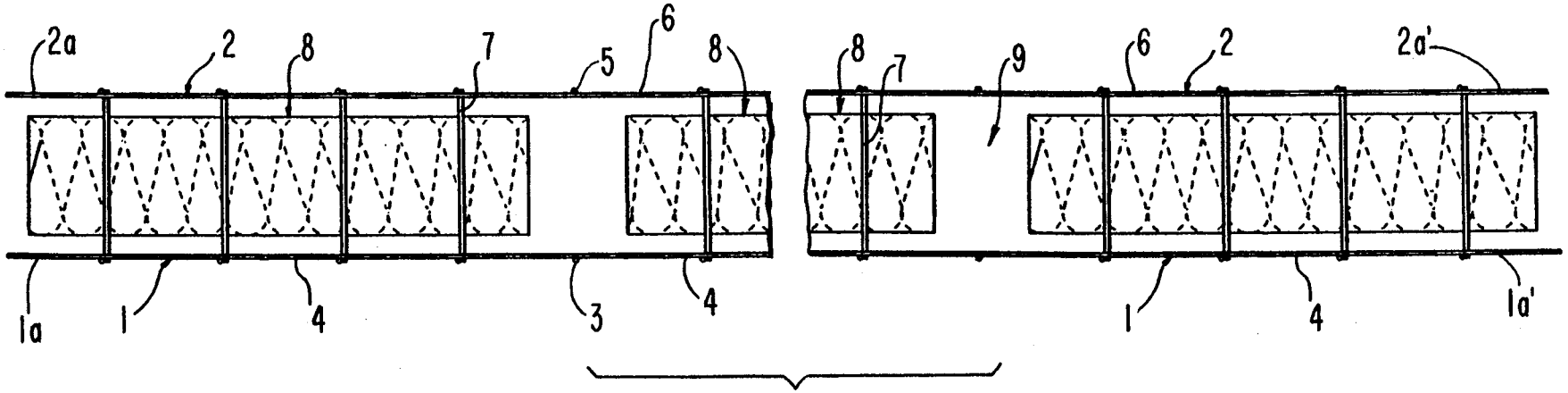

FIG. 6 illustrates a reinforcement body with displacement bodies therein and relatively offset end portions of foundation and distribution reinforcements.

DETAILED DESCRIPTION

Figure 1:
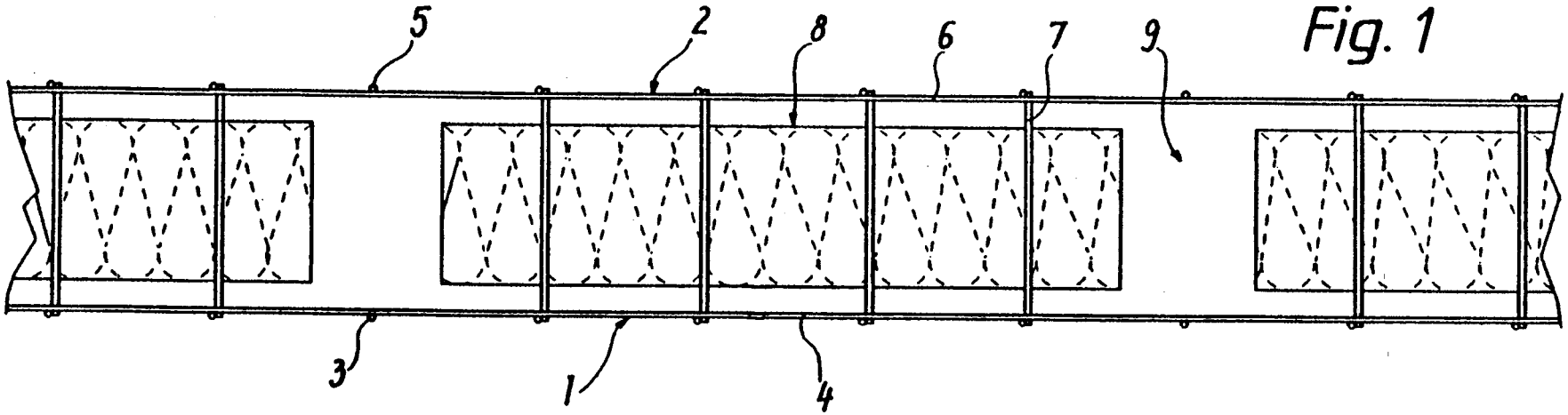
FIG. 1 shows a cross-section through a reinforcement body according to the invention.

FIG. 1 illustrates a reinforcement body for a concrete floor slab, provided with stiffening ribs. It consists of a foundation reinforcement 1 and a distribution reinforcement 2 which advantageously form an all-round compact smooth body. The foundation reinforcement 1 and the distribution reinforcement 2 consist of reinforcement mats in the example shown, which in turn are each formed from longitudinal wires 3 or 5 and transverse wires 4 or 6 welded to one another and extending vertically to one another.

The foundation reinforcement 1 and the distribution reinforcement 2 are connected to one another by means of spacer wires 7 extending between the appropriately aligned longitudinal wires 3 or 5 and are welded to the latter. It is also possible to connect appropriately aligned transverse wires 4 or 6 to the spacer wires 7 within the scope of the invention. The distance of the foundation reinforcement 1 to the distribution reinforcement 2 and hence the length of the spacer wires 7 can be selected freely and can be adapted in each case to the static requirements of the floor slab to be reinforced.

A displacement body 8 of predetermined height, which advantageously consists of foam, for example polystyrene, is arranged between the foundation reinforcement 1 and the distribution reinforcement 2 at a predetermined distance to these reinforcements, and makes it possible to save on concrete in the floor slab to be reinforced and hence to reduce its weight. The displacement body 8 may have a one-part design within the scope of the invention, however, several displacement bodies may also be provided.

Figure 2:
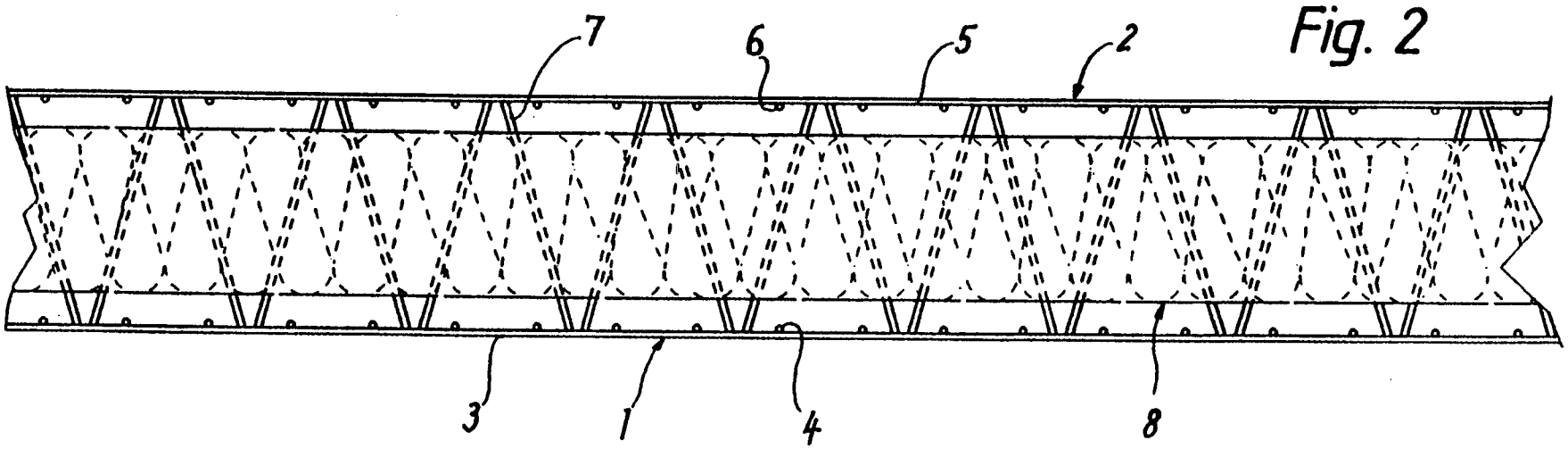
FIG. 2 shows a longitudinal section through the reinforcement body according to FIG. 1.

The spacer wires 7 penetrate the displacement body 8 and are arranged as shown in FIG. 2 at an angle with respect to a plane defined by the body 1, such that the displacement body 8 is rigidly fixed permanently between the foundation reinforcement 1 and the distribution reinforcement 2. This provides for acceptance of shear forces. The displacement body is prevented from slipping when handling the reinforcement body and floating of the displacement body is prevented when concreting the floor slab by fixing the displacement body relative to the reinforcements 1, 2 in this manner.

When using several displacement bodies 8, they are arranged at a lateral distance from one another so that rib cavities 9 of predetermined width are produced. This exact distance may be maintained during the manufacture of the reinforcement body with the aid of separator pieces or spacers not shown.

For a one-part displacement body 8, the rib cavities 9 are either made from the displacement body during the manufacture of the reinforcement body, for example punched out from the displacement body 8, or a displacement body already provided with rib cavities is used. The rib cavities 9 advantageously extend parallel to the longitudinal wires 3 or 5, but may also extend parallel to the transverse wires 4 or 6. It is also possible within the scope of the invention to provide rib cavities parallel to the longitudinal wires and at the same time rib cavities parallel to the transverse wires, depending on the intended use of the floor slab to be reinforced. The rib cavities 9 are filled with concrete during the manufacture of the floor slab to be reinforced and thus form the stiffening ribs of the floor slab. The width of the rib cavities 9 must therefore be selected in accordance with the static requirements placed on the stiffening ribs of the floor slab to be reinforced.

FIG. 2 shows one possible arrangement of the spacer wires 7, wherein all spacer wires 7 extending between two allotted longitudinal wires 3 or 5 are arranged at an angle to one another alternately in opposite directions in the form of half-timbering. This arrangement enables the spacer wires 7 to fix the displacement body in its position in the reinforcement body and also to absorb shear forces acting on the reinforcement body parallel and vertically to the longitudinal wires 3 or 5.

Other possibilities for the arrangement of the spacer wires 7, which ensure a rigid and permanent position for the displacement bodies 8 relative to the foundation reinforcement 1 and the distribution reinforcement 2, are also given within the framework of the invention. It is possible, for example to arrange all spacer wires between two allotted longitudinal wires inclined in the same direction like a herring-bone, and to arrange all spacer wires between neighbouring allotted longitudinal wires likewise inclined in the same direction, but in the opposing direction to the first-mentioned band of spacer wires.

As shown in FIG. 1, the rib cavities 9 may be free of spacer wires. This embodiment of the reinforcement body of the invention is selected for those applications in which either reinforcement of the stiffening ribs of the floor slab to be reinforced is not required for static reasons, or for the arrangement of the spacer wires in which the latter are only intended for fixing the displacement body in the reinforcement body and the spacer wires otherwise have no further static functions. Of course the rib cavities 9 must then also always remain free of spacer wires, if the placing of additional reinforcement elements for reinforcing the stiffening ribs in the rib cavities 9 is made difficult or even impossible by any spacer wires which are present, as is described using the following exemplary embodiments.

Figure 3:
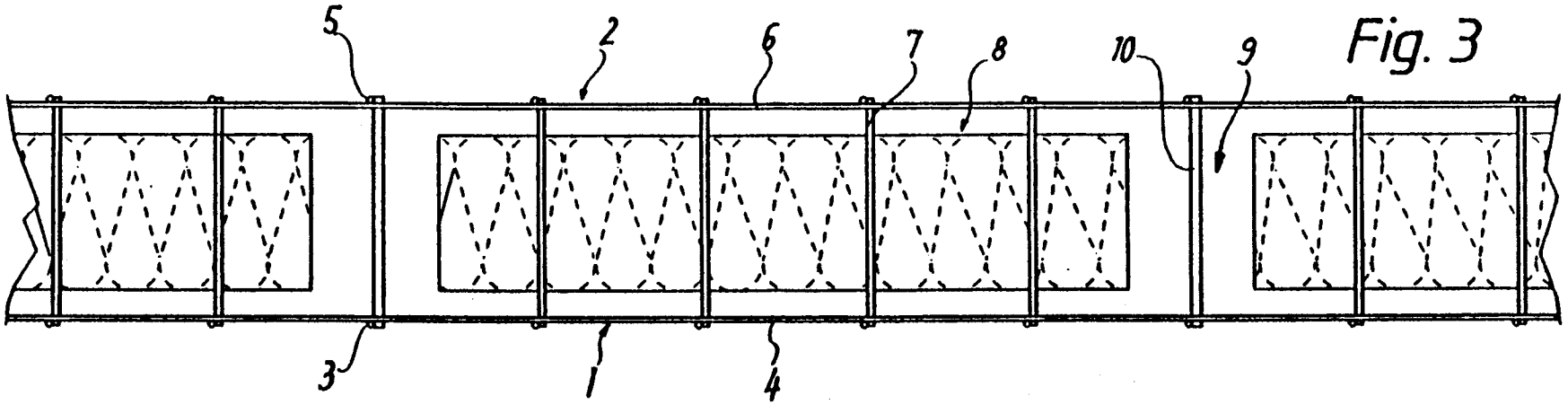
FIG. 3 shows a further reinforcement body according to the invention with additional reinforcement elements for reinforcing the stiffening ribs.

FIG. 3 shows an exemplary embodiment of a reinforcement body according to the invention having additional reinforcement elements 10, which are placed in the rib cavities 9 to reinforce the stiffening robs of the floor slab. The reinforcement elements 10 are advantageously designed as shear reinforcement elements, but may also be designed as a tension and/or compression reinforcement element depending on the static requirements of the floor slab to be reinforced.

As shown in FIG. 4*a*, the reinforcement elements placed in the rib cavities 9 to reinforce the stiffening ribs may also consist of lattice girders 11 comprising in each case an upper rib 12, a lower rib 13 and infill wires 14 extending in zig-zags diagonally between upper rib and lower rib. It is also possible to place additional reinforcement elements 15, for example in the form of individual rods, in the rib cavities 9, the arrangement of the additional reinforcement elements 15 being freely selectable in accordance with the static requirements.

The reinforcement bodies according to the invention form a dimensionally stable unit which can easily be transported to the user in the prefabricated state and processed by him without undesirable displacement of the reinforcements with respect to one another, or displacements of the displacement body with respect to the reinforcements, taking place. The placing of the reinforcement elements 10, 11, 15 in the rib cavities 9 may be carried out by the user on site, but may also be carried out even in the manufacturer's factory. In the latter case, the reinforcement elements 10, 11, 15 are connected at least to the foundation reinforcement 1, in particular welded, it being possible for this connection to be either only positive or also non-positive, depending on the static requirements of the floor slab to be reinforced.

As also shown in FIG. 4*a*, directly after its manufacture the reinforcement body of the invention may be provided with a concrete prefabricated slab 16 and distributed as a so-called prefabricated element floor. The concrete layer of the prefabricated slab 16 thus covers the foundation reinforcement 1 completely.

FIG. 4*b* shows a reinforcement body, the embodiment of which corresponds to the reinforcement body shown in FIG. 4*a*, only the additional reinforcement elements having been omitted. A concrete topping 17 may be produced either in one operation as one piece together with the prefabricated slab 16, or may even only be concreted onto the prefabricated slab 16 later, for example on site by the user. The concrete topping 17 on the one hand fills the rib cavities 9, so that the stiffening ribs of the floor slab are thus produced, on the other hand it covers the distribution reinforcement 2.

FIG. 5 shows a further embodiment of a reinforcement body according to the invention. Here, the distribution reinforcement 2 is interrupted in the region of the rib cavities 9 to provide space for a lattice girder 11, which, for static reasons and/or for reasons determined by the method of manufacture for the floor slab, must have dimensions such that it projects beyond the distribution reinforcement 2. This is necessary, for example if the finished floor slab has to have a very thick concrete topping 17 for static reasons, or if a large span is required for the assembly attachment when concreting the floor slab. The additional reinforcement elements 15 are arranged outside the lattice girder 11 in contrast to the embodiment according to FIG. 4*a*.

For many applications it is necessary to arrange several floor slabs next to one another, wherein in most cases the connecting reinforcements have to cover one another in an overlap joint for static reasons. For these applications, the reinforcement body of the invention is designed such that in a floor slab, the end portion 1*a* of the foundation reinforcement projects beyond the end portion 2*a* of the distribution reinforcement on one side, whereas at the other side, to receive a reinforcement body of a neighbouring floor slab, the end portion 2*a* of the distribution reinforcement 2 projects laterally of the end portion 1*a'* of the foundation reinforcement 1, or vice versa, see FIG. 6*a*. An embodiment of the reinforcement body of the invention is also possible, in which the foundation reinforcement projects beyond the distribution reinforcement on one side of the reinforcement body and the distribution reinforcement projects beyond the foundation reinforcement on the opposite side of the same reinforcement body. In all cases, an overlap joint is achieved as a result of these embodiments of the reinforcement body of the invention for adjacent arrangement of several floor slabs.

It is obvious that the exemplary embodiments described may be modified occasionally within the framework of the scope and nature of the invention, in particular with regard to the type and design of the additional reinforcement elements for the stiffening ribs.

We claim:

1. Reinforcement body for a cast concrete floor slab provided with stiffening ribs, comprising a plurality of elongated foundation reinforcements (1);

a plurality of elongated distribution reinforcements (2) positioned essentially parallel to and spaced from the foundation reinforcements, at least one of said reinforcements defining a floor plane;

straight spacer wires (7) welded to the foundation reinforcements (1) and the distribution reinforcements (2), for connecting the foundation reinforcements and the distribution reinforcements at predetermined distances, said spacer wires (7) being positioned at an angle with respect to the floor plane to provide shear resistance;

a plurality of displacement element blocks (8) arranged between said reinforcements and being penetrated by said spacer wires (7), said displacement element blocks (8) being spaced from each other along the length of the reinforcements, the spacing between adjacent displacement element blocks (8) defining rib cavities (9), said rib cavities (9) having a predetermined directional course in said reinforcement body and a predetermined width, in accordance with static requirements of said slab;

said displacement element blocks (8), when in position between the foundation reinforcements (1) and the distribution reinforcements (2), being rigidly coupled to the spacer wires (7*a*);

the foundation reinforcements (1), the distribution reinforcements, said spacer wires (7) and the displacement body blocks (8) forming a dimensionally stable unit; and reinforcement elements located in said cavities;

said reinforcement elements comprising lattice girders (11), placed in the rib cavities between said displacement element blocks (8) and securely connected to at least one of said foundation reinforcements (1) and said distribution reinforcements (2), and extending between said foundation reinforcements (1) and said distribution reinforcements (2), said lattice girders (11) comprise an upper rib (12), a lower rib (13), and infill wires (14) connecting said upper rib and said lower rib, whereby, upon casting of concrete into said rib cavities (9), said concrete in the rib cavities will be reinforced by said lattice girders (11) and thereby securely connected to said at least one of the foundation reinforcements and distribution reinforcements.

2. Reinforcement body according to claim 1, wherein the lattice girders (11) comprise additional individual rod elements (15).

3. Reinforcement body according to claim 1, wherein the lattice girders (11) in the rib cavities (9) are connected to both the foundation reinforcements (1) and the distribution reinforcements (2).

4. Reinforcement body according to claim 1, wherein the lattice girders (11) in the rib cavities (9) are welded to both the foundation reinforcements (1) and the distribution reinforcements (2).

5. Reinforcement body according to claim 1, wherein one (1) of the foundation reinforcements (1) and the distribution reinforcements (2) project laterally of the other (2) reinforcements on one side of the reinforcement body and the other reinforcement (2) project laterally of said one reinforcement (1) on the opposite side.

6. Reinforcement body according to claim 1, further including a prefabricated slab (16) covering the foundation reinforcement (1).

7. Reinforcement body according to claim 5, further including a concrete topping (17) covering the distribution reinforcements (2) and filling the rib cavities (9) and, at least in part, forming said stiffening ribs.

8. Reinforcement body according to claim 1, further comprising concrete material located in said rib cavities (9) and surrounding and embedding said reinforcement lattice girders (11).

9. Reinforcement body according to claim 1, wherein the displacement elements blocks (8) comprise foam material.

10. Reinforcement body according to claim 2, wherein the displacement element blocks (8) comprise foam material.

11. Reinforcement body according to claim 3, wherein the displacement element blocks (8) comprise foam material.

12. Reinforcement body according to claim 5, wherein the displacement element blocks (8) comprise foam material.

13. Reinforcement body according to claim 6, wherein the displacement element blocks (8) comprise foam material.

14. Reinforcement body according to claim 7, wherein the displacement element blocks (8) comprise foam material.

* * * * *